United States Patent [19]

Fox

[11] 4,391,083

[45] Jul. 5, 1983

[54] PACKING MACHINE

[75] Inventor: Austin L. Fox, London, England

[73] Assignee: Molins Limited, London, England

[21] Appl. No.: 163,457

[22] Filed: Jun. 27, 1980

[51] Int. Cl.[3] ..... B65B 19/24

[52] U.S. Cl. ..... 53/575; 53/234; 198/378; 198/694; 414/223; 414/226; 493/164; 493/247

[58] Field of Search ..... 53/227, 234, 575; 493/247, 164, 105; 198/378, 694; 414/223, 226

[56] References Cited

U.S. PATENT DOCUMENTS

| | | | |
|---|---|---|---|
| 467,040 | 1/1892 | Mellen | 53/234 |
| 1,131,881 | 3/1915 | Wilbur | 53/227 X |
| 1,519,177 | 12/1924 | Volkmer | 53/234 |
| 1,926,192 | 9/1933 | Bronander | 53/575 X |
| 2,196,666 | 4/1940 | Moore | 53/575 X |
| 3,760,472 | 9/1973 | Kielma | 29/568 |
| 3,762,036 | 10/1973 | Goebel | 29/568 |
| 4,014,156 | 3/1977 | Klahn et al. | 53/227 X |

FOREIGN PATENT DOCUMENTS

WO80/0002-46 2/1980 PCT Int'l Appl. ..... 53/575

*Primary Examiner*—John Sipos
*Attorney, Agent, or Firm*—John C. Smith, Jr.

[57] ABSTRACT

A packing machine for cigarettes, in particular for soft packs, with a plurality of pack-forming assemblies 1–16, has at least one operating member 21–23 in each assembly which is movable, e.g. to clamp a sheet of foil 300 or a paper lable 400 against a packet mandrel 20. The assemblies are each indexed past a number of stations at each of which a drive shaft 33 (FIG. 3) engages a coupling shaft 35 connected to the respective operating member. The shafts lie perpendicular to the direction of movement of the assemblies and they engage with one another through a tongue 34 and fork 36 coupling.

The coupling shaft 35 may be connected to the operating member through an eccentric 52 or, where the operating member has to be moved linearly, through a rack and pinion 61.

9 Claims, 5 Drawing Figures

9
10
11
12
13
14
15
16
21
22
23
24
100

PACKING MACHINE

This invention relates to packing machines, and more particularly to mechanisms for handling sheets of packaging material such as metallic foil or paper in such machines.

The invention is applicable to packing machines in which a plurality of pack-forming assemblies are mounted on a movable carrier, such as a rotatable support member, which is moved intermittently to cause the pack-forming assemblies to be stationary at successive stations, each assembly including at least one operating member which is moved relative to other parts of the assembly while the assembly is stationary at one or more of said positions; such a machine will hereinafter be termed a machine of the type as defined.

In machines of the type defined it is clearly necessary to provide means for driving the operating members of the pack-forming assemblies while the support member is stationary, and it is an object of the present invention to provide simple but efficient means for this purpose.

According to the invention, there is provided a packing machine comprising a movable carrier, a plurality of pack-forming assemblies mounted on said movable carrier, means for moving said carrier intermittently so that each of said assemblies stops at each of a plurality of stations in succession, and at least one operating member in each assembly which is movable relative to another part of the assembly, in which said operating member is drivingly connected to a coupling shaft extending at right-angles to the direction in which the assembly moves between successive stations and a driving shaft is provided at each station whereat said operating member is to be moved, said driving shaft at each station being so located that when each assembly is stopped at that station the driving shaft is in axial alignment with the coupling shaft of that assembly and at least one tongue on the end of one of said shafts is engaged with a slotted end of the other of said shafts to provide a drive connection therebetween.

Preferably the movable carrier is a rotary member and the coupling shafts of the pack-forming assemblies are radially spaced from the axis on which said member is rotatable.

Each coupling shaft may carry cam means arranged to move the operating member, or it may carry a pinion engaged with a rack connected to the operating member. A plurality of operating members may be provided in each pack-forming assembly, with separate coupling shafts for respective operating members, one or more of said coupling shafts carrying an eccentric or cam and one or more others of said shafts carrying a pinion engaged with a rack. For example, in one preferred embodiment of the invention each pack-forming assembly may have operating members serving as clamps to hold pieces of packaging material (such as metallic foil or paper) against a mandrel about which they are to be folded, said clamps being moved by eccentrics on respective coupling shafts, and a further operating member in the form of a support finger secured to a rack moved by a pinion on its respective coupling shaft.

In order that the invention may be well understood, a preferred embodiment thereof will now be described, with reference to the accompanying drawings in which:

FIGS. 1A and 1B respectively show in elevation, the upper and lower halves of a rotary member carrying pack-forming assemblies;

Figure 1A:
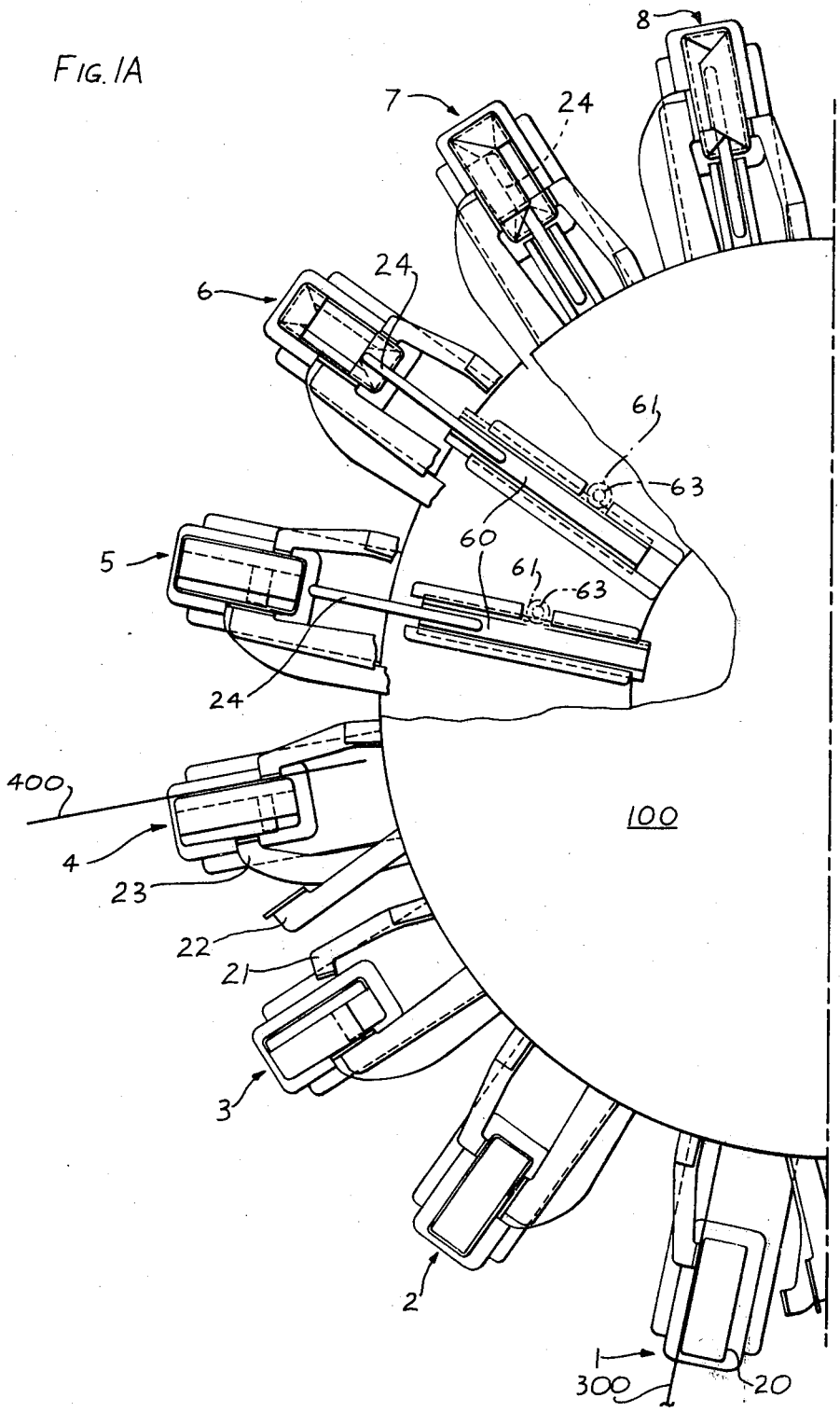
Figure 1B:
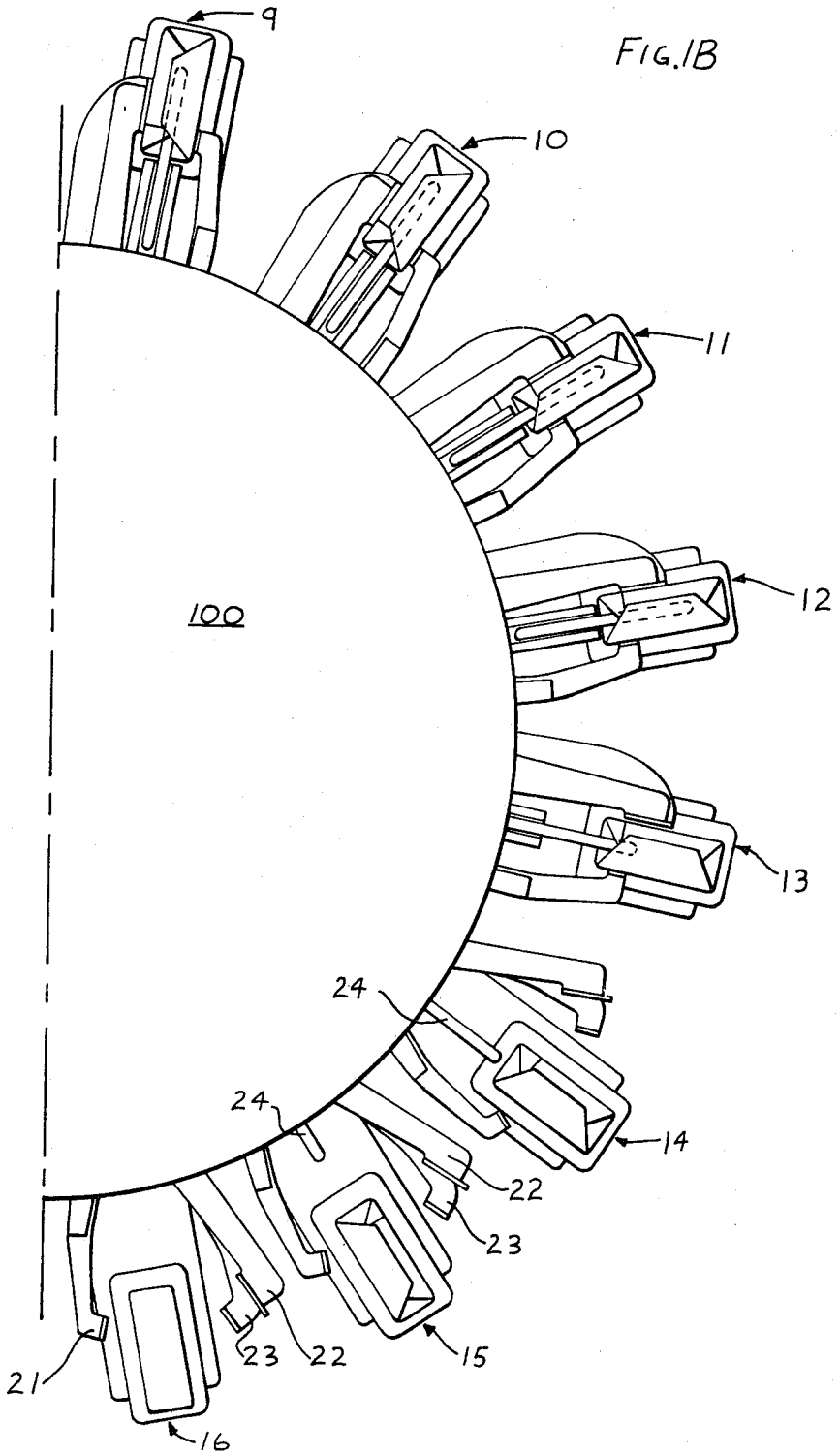

Referring first to FIGS. 1A and 1B, there is shown a rotary member which is part of a machine for packing cigarettes in so-called "soft" packs, i.e. a pack comprising a sheet of metallic foil folded and tucked to enclose a group of cigarettes, and a sheet of paper folded and tucked to enclose all but one end of the foil-wrapped group.

The rotary member comprises a central support assembly generally indicated at 100 which rotates intermittently in a clockwise direction, as viewed in FIGS. 1A and 1B, and carries sixteen pack-forming assemblies 1–16 at regular spacings around the periphery of the rotary member. In each assembly there is a hollow pack-forming mandrel 20, three sheet clamps, 21, 22, 23, and an end support member 24.

In operation, a soft pack is formed upon each mandrel 20 by folding a foil sheet and a paper sheet to form a tube around the mandrel, and further folding to close one end of the tube. Then, after an interval to allow the adhesive securing the foil and paper folds to dry at least partially, the pack is removed from the mandrel by pushing out a group of cigarettes previously placed in the mandrel, the cigarettes engaging the inside face of the closed end of the pack to slide it off the mandrel. The cigarettes may be inserted in the mandrel at any convenient position, as it is immaterial whether or not they are in the mandrel during folding of the foil and paper.

Returning to FIGS. 1A and 1B, a sheet of foil 300 is shown just after being fed to the mandrel 20 of assembly 1, and a paper sheet (termed a "label") 400 is shown just after being fed to the mandrel 20 of assembly 4. Upon reaching the position shown, which will be termed the first station, the assembly 1 has its clamps 21, 22 and 23 lifted clear of the naldrel 20 (as shown for the assembly 16), and the sheet of foil 300 is immediately fed across the leading face of the mandrel 20 and the clamp 21 moved into the position shown to clamp the foil 300. The next movement of the rotary member brings the assembly 1 to the second station, i.e. where assembly 2 is shown, and during this movement the foil is folded along the narrow side faces of the mandrel 2 by fixed folders (not shown); as soon as the assembly 1 stops at the second station, movable folders (not shown) fold the ends of the foil onto the rear face of the mandrel 20 and clamps 22, 23 are moved toward the rear face of the mandrel to hold the ends of the foil thereon.

The next two movements of the rotary member bring the assembly 1 to the fourth station (the position at which the assembly 4 is shown). While the assembly is stationary at the third station the clamp 21 is lifted clear of the mandrel 20 so that on arrival at the fourth station the label 400 can immediately be fed across the leading face of the mandrel 20, and the clamp 21 promptly returned towards the mandrel to hold the label against the foil already surrounding the mandrel. At the fourth station, the clamp 22 is moved away from the rear face of the mandrel 20, the clamp 23 remaining in position to retain the foil on the mandrel; the label is narrower than the foil, i.e. it does not extend so far along the mandrel as does the foil, and the clamp 23 engages that part of the foil which extends beyond the label, remote from the end of the mandrel visible in the drawing.

As the assembly 1 moves to the fifth station (where the assembly 5 is shown) further folders (not shown) fold the label around the side faces and on to the rear face of the mandrel, and at the fifth station the clamp 22 is moved back towards the mandrel to hold the label, now formed into a tube around the mandrel outside the foil.

End portions of the foil and label project beyond the end of the mandrel which is shown in the drawing, and are folded down across the end of the mandrel with conventional tucks and folds; the end portion of the foil is partially folded when the assembly 1 reaches the fourth station, and the folding of the end portion of the foil is completed as the end portion of the label is folded, while the assembly 1 is advanced from the fifth to the eighth station.

To assist in the end folding, an elongated support finger 24 is moved across the end of the mandrel 20. The finger 24 commences to move across the end of the mandrel at the sixth station, at which stage narrow end tucks have been folded across the end of the mandrel and long flaps have been formed but not yet folded down. The finger 24 is fully advanced across the end of the mandrel at the seventh station, providing a firm support against which the long flaps can be properly formed and pressed together, so that adhesive between said long flaps commences to form a proper bond. A heated, fixed plough folder (not shown) is provided to fold down the second (outer) long flap and to hold it down as the assembly 1 passes from the seventh to the twelfth station, and the finger 24 remains in position across the end of the mandrel 20 to support the long flaps as long as the heated plough folder is pressing against said flaps. The finger 24 is withdrawn while the assembly 1 passes from the twelfth to the sixteenth station.

Figure 2:
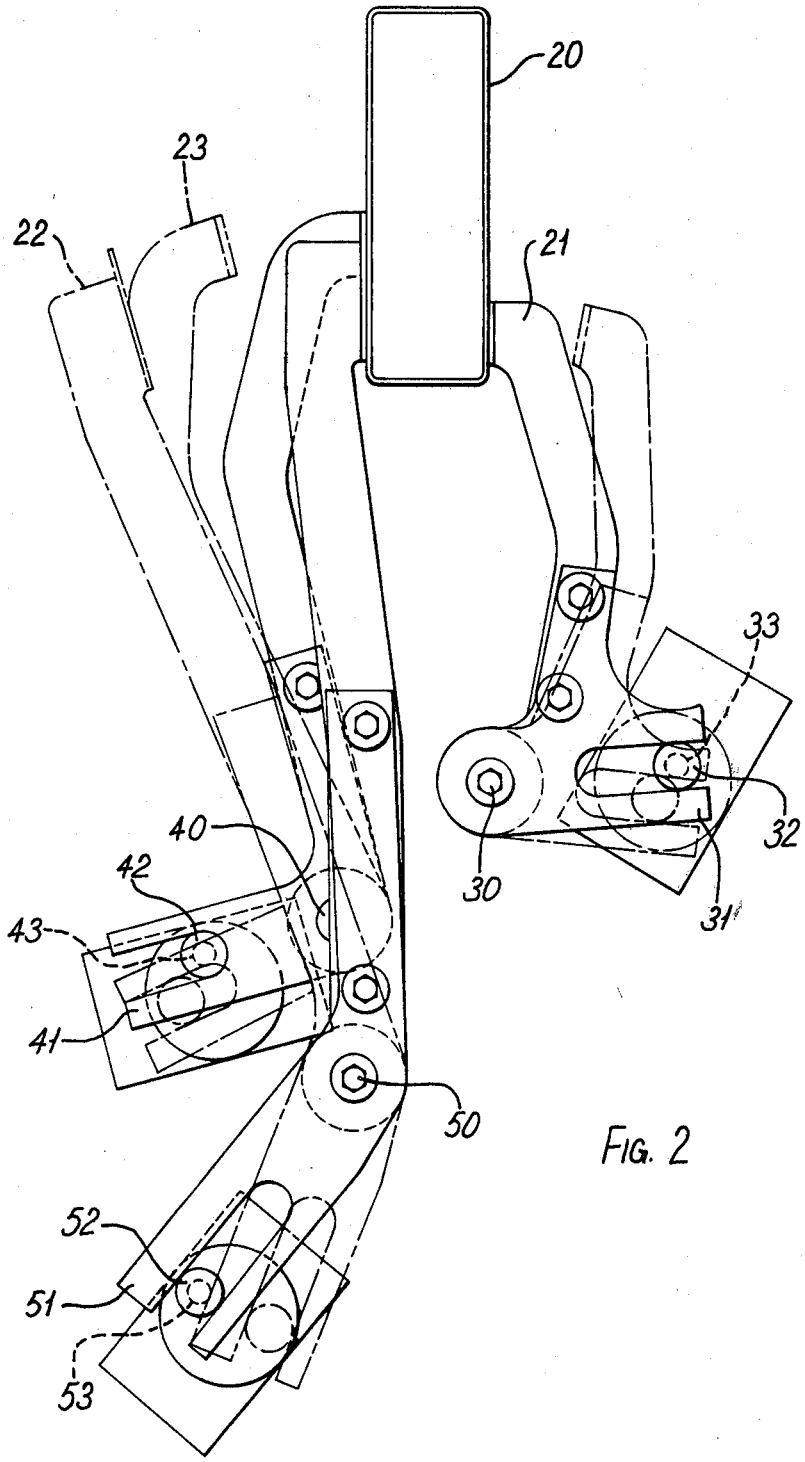
FIG. 2 is a detail view, on a larger scale, of parts of one pack-forming assembly.
Figure 3:
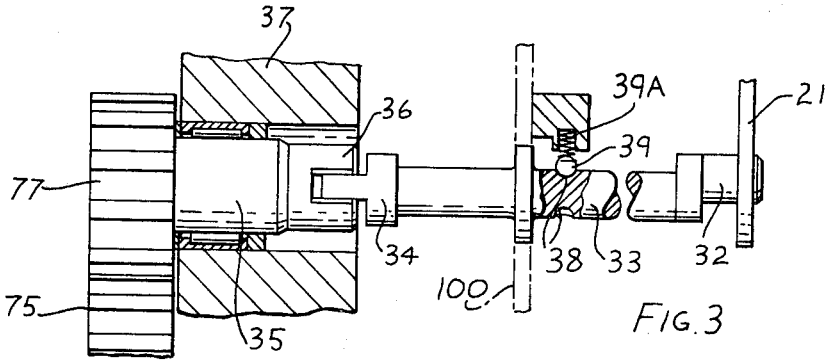
FIG. 3 is a detail view, also on the larger scale, of a shaft coupling.

The movements of the clamps 21, 22, 23 and of the finger 24 all take place while the rotary member 100 is stationary. Referring now to FIGS. 2 and 3, the clamp 21 of each pack-forming assembly is one arm of a bell-cranked pivoted at 30; the other arm of said bell-crank carries a fork 31 for receiving a pin 32 which is eccentrically carried by one end of a shaft 33. The shaft 33 is journalled in the rotary member 100 and has its other end projecting from the rotary member, the projecting end terminating in a tongue 34 (FIG. 3).

At each station where a movement of the clamp 21 is required, a drive shaft 35 with a slotted end 36 is provided. The drive shaft 35 is journalled in a mounting 37 which is so located that as each pack-forming assembly stops at that station, the shaft 33 stops in axial alignment with the drive shaft 35 so that the tongue 34 of the shaft 33 of that assembly stops within the slotted end 36 to provide a drive coupling between drive shaft 35 and shaft 33. The drive shaft 35 is then rotated by a drive means, as described below, and the shaft 33 is turned to move the clamp 21 by the action of the eccentric pin 32 engaging the fork 31 of the bell-crank; only one half turn of the shaft 33 is needed to move the bell-crank through its full range of movement, so that the clamp 21 moves from its clamping position (shown in full line, FIG. 2) against the mandrel 20 to a fully withdrawn position (shown in chain-dotted line) or vice versa.

The clamps 22, 23 are similarly operated, being one end respectively of bell-cranks pivoted at 40, 50 respectively; the other ends of said bell-cranks are forked as at 41, 51, and receive eccentric pins 42, 52 on shafts 43, 53. The shafts 43, 53 are provided with tongues (not shown) similar to tongue 34, received in slotted ends of drive shafts (not shown) similar to shaft 35, at each station at which movement of the respective clamp is required.

The finger 24 is secured to a slider 60 (FIG. 1A) which is provided with rack teeth along one edge, said teeth being engaged with a pinion 61 on a shaft 62. The shaft 62 has a tongue similar to the tongue 34 for engagement with the slotted ends of drive shafts similar to shaft 35 at those stations where movement of the finger 24 is required; and if desired the pinion 61 may be rotated a multiple of half turns at such stations.

The drive shaft 35, and all the other similar drive shafts, are always stopped, prior to movement of the rotary member 100, in angular positions such that the tongues 34 of the cooperating shafts 33, 43, 53, 63 are at right-angles to a radius from the rotational axis of the rotary member 100.

To ensure that the shafts 33, 43, 53 and 63 always end their movements at such angular positions, each shaft is formed with two part-spherical depressions 38 disposed diametrically opposite one-another. A ball detente 39 housed in the rotary member 100, and biassed by a spring 39A against the shafts 33, enters one of the depressions 38 at the end of each half rotation of the shaft to urge and retain the shaft at its correct angular position.

The tongues 34 are slightly thinner than the width of the slots in the slotted ends 36 of the drive shafts 35, so that each tongue can move freely out of the slotted end 36 of each drive shaft when the member 100 rotates, and the corresponding tongue in the next pack-forming assembly can freely enter the slotted end of the drive shaft as a movement of the rotary member 100 is completed.

As a further precaution that the tongues 34 of the shafts 33 etc. will always be disposed in the correct angular positions for entering the slotted ends 36, the mounting 37 is provided between adjacent drive shafts 35 with arcuate grooves (not shown) of a width similar to that of the slots in the slotted ends 36. By this means the tongues 34 are constrained at all times between stations from moving away from their correct angular positions.

Figure 4:
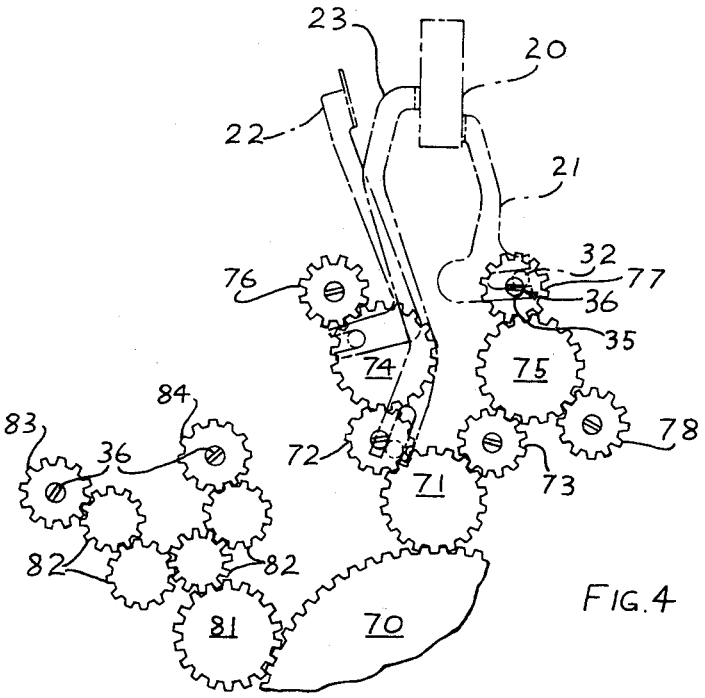
FIG. 4 is a view in elevation of part of the actuating drive to the pack-forming assemblies.

The drive to operate the clamps 21 to 23 is shown in FIG. 4. A main gear 70 is concentric with the rotary member 100 and is indexable in angular increments of about 30° at each stationary position of the rotary member. The gear 70 meshes via an idler gear 71 with two drive gears 72 and 73, which in turn mesh through idler gears 74 and 75 with drive gears 76, 77 and 78. As shown in FIG. 3, the drive gear 77 is connected to the end of the drive shaft 35 remote from the slotted end 36, the remaining drive gears being similarly connected to respective drive shafts.

The gear ratios and the 30° indexing movement of the main gear 70 are so chosen that each drive shaft 35 is rotated through one half turn, so that for example, in the position shown the clamp 21 is moved to its inner extremity, as described in detail above.

To the left of the gear train 71 to 78 is one of a number of further gear trains disposed about the gear 70. This consists of a large idler 81, four small idlers 82 and two drive gears 83 and 84.

The gears 76, 77 and 83 are all disposed at the same radial distance from the main gear 70, and the arcuate spacing between the gears 76 and 77 corresponds to the distance between two pack-forming assemblies, whereas that between gears 83 and 76 corresponds to two such distances. Thus with the rotary member 100 being intermittently moved from the station corresponding to gear 83 to that corresponding to gear 77, the gear 83, for example, serves to actuate each clamp 21 at a first station; at the next station there is no gear, so that the position of the clamp will remain unchanged; at the third station the gear 76 releases the clamp; and at the fourth station the gear 77 again actuates the clamp 21.

Similarly the gears 72 and 73 successively serve to activate and deactivate the clamp 22 of each assembly 1 to 16; and the gear 84 and 78 may serve, for example, to operate each finger 24.

I claim:

1. A packing machine comprising:

(a) a movable carrier;

(b) a plurality of packet-forming assemblies mounted on said movable carrier, each assembly comprising a stationary member and at least one operating member mounted for movement towards and away from said stationary member;

(c) means for moving said carrier intermittently along a path so that each of said assemblies stops successively at each of a plurality of stations; and (d) means for positively driving said at least one operating member of each of said assemblies to progressively move said operating member towards and away from said stationary member, said driving means comprising at least one coupling shaft rotatably mounted on said movable carrier and operatively connected to said at least one operating member, said coupling shaft extending transverse to the directional movement of said assembly along said path between successive stations, and at least one rotatably mounted driving shaft at each of a selected plurality of said stations where at least one operating member of each of said assemblies is to be moved, said at least one driving shaft at each of said selected stations being so located that when each of said assemblies is stopped at each of said selected stations said at least one driving shaft is in axial alignment with said at least one coupling shaft on said movable carrier, the end of one of said shafts having at least one tongue and the end of the other of said shafts having at least one corresponding slot, said tongue and slot being arrangedto engage each other to provide a drive connection therebetween when said driving and coupling shafts are in axial alignment.

2. A machine according to claim 1 in which said movable carrier is a rotary member and said coupling shafts of the pack-forming assemblies are radially spaced from the axis about which said member is rotatable.

3. A machine according to claim 1 in which said operating members are pivotal levers, and in which said coupling shafts carry cam means each engageable with its associated lever for pivotal movement thereof.

4. A machine according to claim 1 in which each operating member comprises a linearly movable rack, and in which each coupling shaft carries a pinion engageable with its associated rack.

5. A machine according to claim 1 in which said tongue is formed on the end of each coupling shaft, each coupling shaft being rotated a whole multiple of half rotations by the slotted end of a respective driving shaft.

6. A machine according to claim 5 in which each coupling shaft comprises spring detent means operable to maintain the shaft during movement between said stations in its correct angular position for engagement with a slotted end of a respective driving shaft.

7. A machine according to claim 2, 3, 4, 5 or 1 in which each driving shaft is rotated through a gear train from a central gear mounted coaxial with said movable carrier.

8. A packing machine for packing groups of row-like articles, in particular cigarettes, comprising:

(a) an indexing rotary member;

(b) a plurality of pack-forming assemblies mounted on said rotary member, each assembly comprising a stationary member and at least one operating member mounted for movement towards and away from said stationary member;

(c) a plurality of work stations disposed adjacent said member.

(d) indexing means for rotating said member intermittently so that each assembly is successively brought to rest at each of said stations; and (e) means for positively driving said at least one operating member of each of said assemblies to progressively move said operating member towards and away from said stationary member, said driving means comprising at least one operating shaft mounted on said rotary member and drivingly connected to said at least one operating member, said operating shaft extending transverse to the direction of movement of said assembly between successive stations, and at least one driving shaft at each of a selected plurality of said stations where at least one operating member of each of said assemblies is to be moved, said at least one driving shaft at each of said selected stations being so located that when each of said assemblies is stopped at each of said selected stations said at least one operating shaft is brought to rest in axial alignment with said at least one driving shaft; and (f) coupling means between said operating and driving shafts comprising a tongue at the end of one shaft and a corresponding slot in the end of the other shaft, said tongue and slot being arranged to engage each other when said driving and operating shafts are in axial alignment.

9. A machine according to claim 8 further comprising means for rotating each driving shaft a whole multiple of half rotations.

* * * * *